US010578006B2

(12) United States Patent
Zielberg et al.

(10) Patent No.: US 10,578,006 B2
(45) Date of Patent: Mar. 3, 2020

(54) METHOD FOR CONTROLLING A MECHANICALLY CONTROLLABLE COOLANT PUMP FOR AN INTERNAL COMBUSTION ENGINE

(71) Applicant: PIERBURG GMBH, Neuss (DE)

(72) Inventors: Stephan Zielberg, Bochum (DE); Andreas Burger, Krefeld (DE); Michael-Thomas Benra, Castrop-Rauxel (DE); Stefan Rothgang, Rheinberg (DE)

(73) Assignee: PIERBURG GMBH, Neuss (DE)

( * ) Notice: Subject to any disclaimer, the term of this patent is extended or adjusted under 35 U.S.C. 154(b) by 141 days.

(21) Appl. No.: 15/772,816

(22) PCT Filed: Oct. 19, 2016

(86) PCT No.: PCT/EP2016/075081
§ 371 (c)(1),
(2) Date: May 2, 2018

(87) PCT Pub. No.: WO2017/076648
PCT Pub. Date: May 11, 2017

(65) Prior Publication Data

US 2018/0313251 A1 Nov. 1, 2018

(30) Foreign Application Priority Data

Nov. 6, 2015 (DE) ..... 10 2015 119 092

(51) Int. Cl.
*F01P 7/00* (2006.01)
*F01P 7/16* (2006.01)
(Continued)

(52) U.S. Cl.
CPC ..... *F01P 7/16* (2013.01); *F04D 15/0038* (2013.01); *F01P 2007/146* (2013.01); *F01P 2023/08* (2013.01); *F01P 2037/02* (2013.01)

(58) Field of Classification Search
CPC .. F01P 7/16; F01P 2007/143; F01P 2007/146; F01P 2023/08; F01P 2037/02; F04D 15/0022; F04D 15/0038
See application file for complete search history.

(56) References Cited

U.S. PATENT DOCUMENTS 3,204,863 A 9/1965 Hausammann
4,070,132 A 1/1978 Lynch
(Continued)

FOREIGN PATENT DOCUMENTS

CN 102149923 A 8/2011
CN 103459854 A 12/2013
(Continued)

*Primary Examiner* — Phutthiwat Wongwian
*Assistant Examiner* — Sherman D Manley
(74) *Attorney, Agent, or Firm* — Norman B. Thot

(57) ABSTRACT

A method for controlling a coolant pump for an engine includes delivering a coolant via a coolant pump impeller into a delivery duct to a pump outlet, and adjusting the delivery based on a position of an adjustable control slide which controls a throughflow cross-section of an annular gap between the coolant pump impeller outlet and the delivery duct. A first pressure chamber on a side of the control slide is filled with a pressurized coolant to decrease the throughflow cross-section and the coolant volume flow delivered to the pump outlet, or a second pressure space arranged on an opposite side is filled with the pressurized coolant to increase the throughflow cross-section and the coolant volume flow delivered to the pump outlet. The control slide is moved into a defined position when the
(Continued)

engine is switched off dependent on a coolant temperature and remains in that position until a restart.

11 Claims, 1 Drawing Sheet

(51) Int. Cl.
*F04D 15/00* (2006.01)
*F01P 7/14* (2006.01)

(56) References Cited

U.S. PATENT DOCUMENTS 4,895,301 A * 1/1990 Kennedy ..... F01P 7/167 236/34.5
6,158,470 A * 12/2000 Ivers ..... F16F 9/46 137/807
6,302,249 B1 * 10/2001 Jolly ..... F15B 11/076 188/269
6,364,213 B1 * 4/2002 Baltz ..... F01P 7/16 123/41.01
8,814,497 B2 * 8/2014 Schmidt ..... F04D 29/586 415/19
10,400,659 B2 * 9/2019 Hoffmann ..... F04B 19/22
2003/0143084 A1 * 7/2003 Repple ..... F01P 5/10 417/292
2008/0003120 A1 * 1/2008 Meza ..... F04B 43/026 417/413.1
2010/0284832 A1 11/2010 Schmidt et al.
2011/0162597 A1 * 7/2011 Draheim ..... F04D 15/0038 123/41.44
2011/0188987 A1 * 8/2011 Schmidt ..... F04B 23/106 415/1
2012/0055652 A1 * 3/2012 Triebe ..... F01P 7/161 165/96
2012/0192816 A1 * 8/2012 Simon ..... F01P 5/10 123/41.44
2012/0204818 A1 * 8/2012 Welte ..... F04D 15/0038 123/41.08
2013/0333863 A1 12/2013 Pawellek
2013/0336822 A1 12/2013 Schmidt et al.
2014/0212267 A1 * 7/2014 Pawellek ..... F01P 7/161 415/26
2014/0322042 A1 10/2014 Durand
2015/0016966 A1 * 1/2015 Fournier ..... F01P 5/10 415/148
2015/0098804 A1 * 4/2015 Russalian ..... F01P 7/14 415/157
2016/0215679 A1 7/2016 Pawellek
2017/0254253 A1 * 9/2017 Hoffmann ..... F04D 13/12
2019/0226490 A1 * 7/2019 Rende, Jr. ..... F04D 29/2266

FOREIGN PATENT DOCUMENTS

CN 103764968 A 4/2014
CN 203516133 U 4/2014
DE 10 2008 026 218 A1 12/2009
DE 10 2011 079 898 A1 1/2013
DE 10 2012 207 387 A1 1/2013
DE 10 2013 018 205 B3 6/2014
JP 2004-108343 A 4/2004
WO WO 2012/119622 A2 9/2012

* cited by examiner

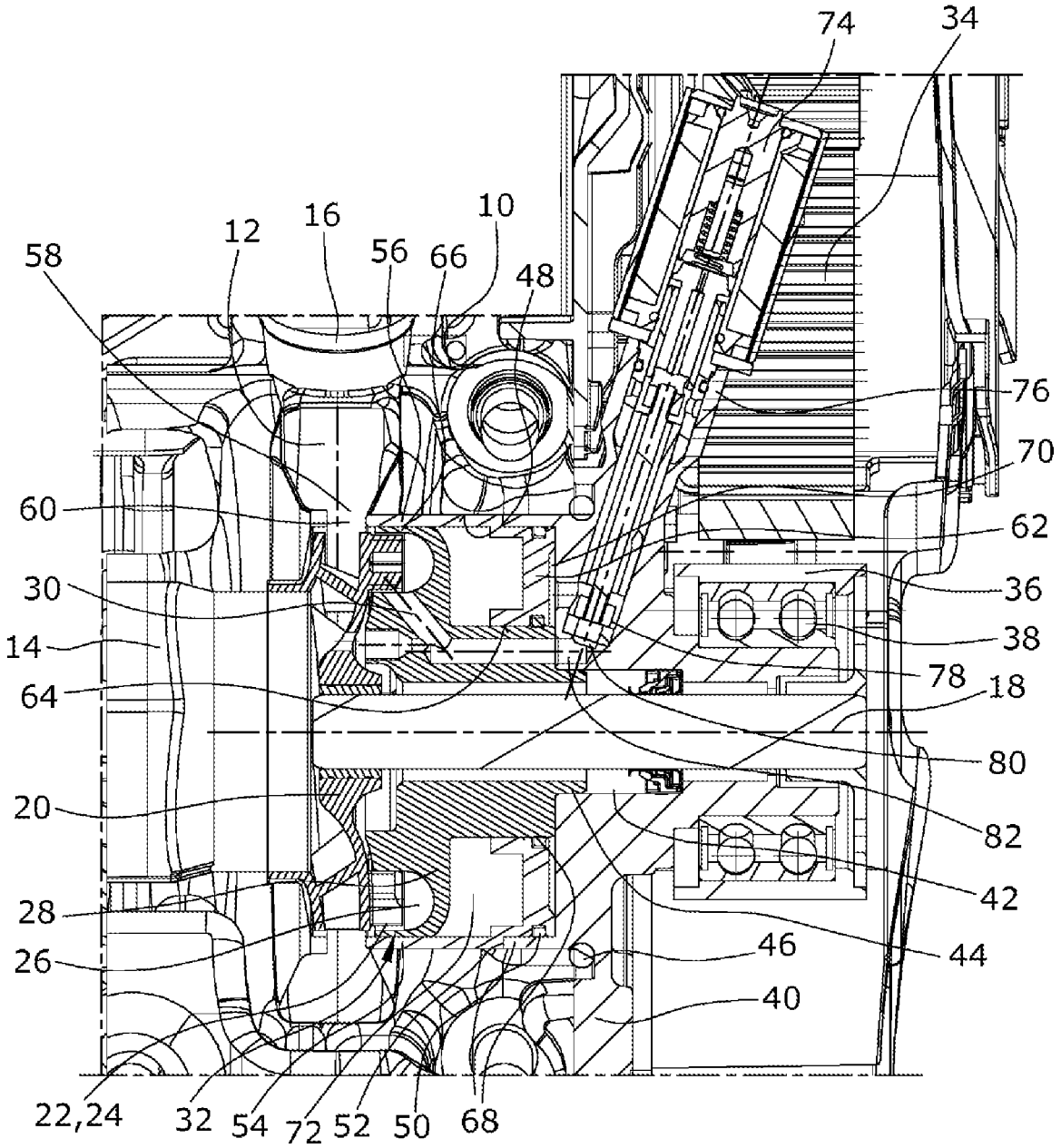
74
34
10
16
12
58
56
66
48
76
70
60
62
30
36
38
14
78
18
64
80
20
82
42
28
46
44
26
40
22,24
32
54
72
52
50
68

METHOD FOR CONTROLLING A MECHANICALLY CONTROLLABLE COOLANT PUMP FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2016/075081, filed on Oct. 19, 2016 and which claims benefit to German Patent Application No. 10 2015 119 092.3, filed on Nov. 6, 2015. The International Application was published in German on May 11, 2017 as WO 2017/076648 A1 under PCT Article 21(2).

FIELD

The present invention relates to a method for controlling a mechanically controllable coolant pump for an internal combustion engine, where a coolant is delivered via a coolant pump impeller into a delivery duct surrounding the coolant pump impeller and to a pump outlet, wherein the delivery depends on the position of an adjustable control slide via which a throughflow cross-section of an annular gap between an outlet of the coolant pump impeller and the surrounding delivery duct is controlled, and wherein for reduction of the coolant volume flow delivered to the pump outlet by decreasing the throughflow cross-section a first pressure chamber on a first axial side of the control slide is filled with a pressurized coolant.

BACKGROUND

Coolant pumps in internal combustion engines serve to control the flow of the delivered coolant to prevent the internal combustion engine from overheating. These pumps are in most cases driven via a belt or a chain drive so that the coolant pump impeller is driven at the speed of the crankshaft or at a fixed ratio to the speed of the crankshaft.

In modern internal combustion engines, the delivered coolant flow must be matched with the coolant demand of the internal combustion engine or the motor vehicle. The cold running phase of the engine should in particular be reduced to prevent increased pollutant emissions and to reduce fuel consumption. This is realized, inter alia, by restricting or completely switching off the coolant flow during this phase.

Various pump designs for controlling coolant flow rate are known. Besides electrically driven coolant pumps, pumps are known which can be coupled to or decoupled from their drive units via couplings, in particular hydrodynamic couplings. A particularly inexpensive and simple manner of controlling the delivered coolant flow is the use of an axially movable control slide which is pushed across the coolant pump impeller so that, for reducing the coolant flow, the pump does not deliver into the surrounding delivery duct but against the closed slide.

The control of this slide is also performed in different ways. Besides a purely electric adjustment, a hydraulic adjustment of the slides has in particular proved successful. A hydraulic adjustment is in most cases carried out via an annular piston chamber which is filled with a hydraulic fluid and whose piston is connected to the slide so that, during filling of the chamber, the slide is moved across the impeller. The slide is returned by opening the piston chamber towards an outlet, in most cases via a magnetic valve as well as by a spring action providing the force for returning the slide.

For the coolant flow required for moving the slide not to be supplied via additional delivery units, such as additional piston/cylinder units, or for other hydraulic fluids not to be compressed for operating purposes, mechanically controllable coolant pumps are known on whose drive shaft a second delivery wheel is arranged via which the pressure for adjusting the slide is provided. These pumps are designed, for example, as side channel pumps or as servo pumps.

A coolant pump having a side channel pump acting as a secondary pump is described in DE 10 2012 207 387 A1. In this pump, via a 3/2-way valve, in a first position, a discharge side of the secondary pump is closed and a suction side of the pump is connected to the coolant circuit and the slide, and in a second position, the discharge side is connected to the slide and the suction side is connected to the coolant circuit. A spring is used to return the slide, which spring may be omitted when the pump is to be reset by the negative pressure produced at the suction connection.

It is, however, problematic that a sufficient coolant pressure initially does not exist when starting the internal combustion engine, via which the control slide is rapidly moved into its position for closing the duct and thus stopping a coolant flow. A rapid control of the coolant flow is thus not possible directly after the start, in particular at an idle speed, so that the heating times cannot be considerably reduced as in the case of an immediate switch-off by moving the control slide into the annular gap.

For vehicles having an automatic start-stop system, several documents therefore suggest a solution wherein, in addition to a mechanically driven pump, an electric pump is arranged in the coolant circuit to maintain the delivery of the coolant at high coolant temperatures even at low speeds. Such an arrangement is described, for example, in WO 2012/119622 A2. In the therein described cooling system, the control slide is to be moved into its position for closing the duct to prevent an undesired cooling during the start. This is, however, only possible in the case of electrically operated actuators since a sufficient hydraulic pressure to move the control slide is normally not provided at idle speed.

SUMMARY

An aspect of the present invention is to provide a method for controlling a mechanically controllable coolant pump for an internal combustion engine wherein, with a single coolant pump, both a rapid undelayed heating of the internal combustion engine and a sufficient coolant flow for preventing overheating can be provided.

In an embodiment, the present invention provides a method for controlling a mechanically controllable coolant pump for an internal combustion engine. The method includes delivering a coolant via a coolant pump impeller into a delivery duct which surrounds the coolant pump impeller to a pump outlet, and adjusting the delivery based on a position of a control slide, wherein the control slide is configured to be adjustable so as to control a throughflow cross-section of an annular gap arranged between an outlet of the coolant pump impeller and the delivery duct. A first pressure chamber arranged on a first side of the control slide is filled with a pressurized coolant to decrease the throughflow cross-section and to thereby decrease the coolant volume flow delivered to the pump outlet, or a second pressure space arranged on a second side of the control slide which is axially opposite to the first side is filled with the pressurized coolant to increase the throughflow cross-section and to thereby increase the coolant volume flow delivered to the pump outlet. The control slide is moved into a defined position during a switch-off of the internal combustion engine dependent on a coolant temperature, wherein the control slide remains in the defined position until the internal combustion engine is started.

BRIEF DESCRIPTION OF THE DRAWING

The present invention is described in greater detail below on the basis of embodiments and of the drawing in which:

FIG. 1 shows a cross-sectional side view of a coolant pump according to the present invention.

DETAILED DESCRIPTION

An expected required coolant flow can be adjusted in advance depending on a respective operating condition, which coolant flow is immediately effective during the start, since for increasing the coolant flow delivered to the pump outlet by increasing the throughflow cross-section pressurized coolant is filled into a second pressure chamber on a side of the control slide axially opposite to the first side, and during switch-off of the internal combustion engine, the control slide is moved into a defined position depending on the coolant temperature in which the control slide remains until the engine is started. This is performed by the purely hydraulic operation of the control slide upon which no permanently effective forces, such as spring forces, act. The control slide accordingly always remains in the position selected during switch-off until the next engine start.

In an embodiment of the present invention, the control slide can, for example, be moved into a position for closing the annular gap during switch-off of the internal combustion engine when the coolant temperature falls below a defined threshold value. During a start of the internal combustion engine, no coolant flow is therefore present, which results in a rapid heating. This position also provides that, during the standstill phase, no coolant flow is, for example, produced by the thermosiphon effect which would lead to a further cooling of the internal combustion engine during a later period of the cold start phase.

It is also advantageous when the control slide is moved into a position for completely opening the annular gap during switch-off of the internal combustion engine when the coolant temperature corresponds to the defined threshold value or exceeds the defined threshold value. Due to this control, no overheating can occur during a new start since a sufficient coolant flow is available even at idle speed because the coolant pump is capable of delivering freely and an additional cooling of the engine is provided by the thermosiphon effect during standstill.

The threshold value can, for example, correspond to a desired value defined in an engine control for the operating temperature of the coolant during operation of the internal combustion engine. This is thus the value to which the coolant is to be set by the engine control during operation of the vehicle to provide a good lubrication and to prevent overheating. Such a threshold value would be approximately 95° C., for example, in a normal motor vehicle.

In an embodiment of the present invention, during a switch-off of the internal combustion engine, the control can, for example, be performed by cutting off the ignition of the internal combustion engine. An optimum coolant flow for the next start can accordingly be preset during cut-off of the vehicle.

Besides the control methods described, it would also be advantageous in this state to move the control slide into a position to close the annular gap independently of the prevailing coolant temperature during a cut-off of the ignition of the internal combustion engine. The driver in this state normally leaves the vehicle for a short or a long period of time so that, due to the long standstill of the vehicle, a sufficient cooling takes place. This is in particular the case when a low ambient temperatures prevail. This would then be preset for the cold start during a new start of the vehicle so that the heating phase would be shortened.

It is also advantageous when the control is performed when switching-off the internal combustion engine during the automatic start-stop operation. During a stop, the control slide is accordingly moved into a position in which an overheating or an undesired cooling is prevented by opening or closing the slide according to the temperature during the stop.

A similar control can, for example, be performed in a coasting mode of the vehicle during which the internal combustion engine is switched off and, accordingly, does not generate any combustion heat. An undesired cooling or heating in this state depending on the operating temperature can also be prevented.

In an embodiment of the present invention, the opening of the annular gap can, for example, also be performed by a progressive pressure increase in the second pressure chamber. This progressive pressure increase leads to a slow and continuous opening of the control slide, whereby a sudden surge of cold water is prevented which could result in an abrupt cooling of the crankcase.

In an embodiment of the method of the present invention, the threshold value for the coolant temperature as a function of the ambient temperature can, for example, be saved in a characteristic map. For lower ambient temperatures, the threshold value can accordingly be set to a higher value since a considerable cooling during a cut-off of the internal combustion engine takes place without any thermosiphon effect.

The desired control is carried out in a particularly simple manner when, depending on the position of a 3/2-way electromagnetic valve, the pressurized coolant is fed to one of the pressure chambers and the 3/2-way electromagnetic valve is driven during the switch-off of the internal combustion engine to move the control slide into the required position. A short signal during cut-off can thus cause the control slide to be rapidly moved into the desired position.

A method for controlling a mechanically controllable coolant pump for an internal combustion engine is thus provided, wherein, already during a cut-off of the engine, the control slide is preset with regard to an optimum new start, whereby overheating is prevented by providing a sufficient coolant flow and a too rapid cooling of the internal combustion engine is prevented. During the start, the control slide is also in the optimum position for shortening the warm-up phases.

The method of the present invention is described below on the basis of a suitable coolant pump for an internal combustion engine as shown in the drawing.

The illustrated coolant pump is composed of an outer housing 10 in which a spiral delivery duct 12 is formed into which a coolant is sucked via an axial pump inlet 14 that is also formed in the outer housing 10, which coolant is delivered via the delivery duct 12 to a tangential pump outlet 16 formed in the outer housing 10 and into a cooling circuit of the internal combustion engine.

For this purpose, radially inside the delivery duct 12, a coolant pump impeller 20 is fastened to a drive shaft 18, which coolant pump impeller 20 is configured as a radial pump wheel, the rotation of which effects the delivery of the coolant in the delivery duct 12. On the side of the coolant pump impeller 20 axially opposite to the pump inlet 14, a control pump impeller 22 is formed which is rotated together with the coolant pump impeller 20. The control pump impeller 22 comprises blades 24 which are arranged axially opposite to a flow duct 26 configured as a side channel formed in a first inner housing part 28. In the first inner housing part 28, an inlet (not shown in the drawing) and an outlet 30 are formed so that the control pump impeller 22 together with the flow duct 26 forms a control pump 32 via which the pressure of the coolant is increased from the inlet to the outlet 30.

The coolant pump impeller 20 and the control pump impeller 22 are driven via a belt 34 which engages with a belt pulley 36 that is fastened to the axial end of the drive shaft 18 opposite to the coolant pump impeller 20. Driving via a chain drive is also possible. The belt pulley 36 is supported on second housing part 40 via a two-row ball bearing 38. The second housing part 40 comprises an inner axial through-going opening 42 into which an annular projection 44 of the first inner housing part 28 projects, via which the first inner housing part 28 is fastened to the second housing part 40. The second housing part 40 is fastened to the outer housing 10 using a seal 46 as an intermediate layer. For this purpose, the outer housing 10 comprises an accommodation opening 48 at its axial end opposite to the pump inlet 14, into which an annular projection 50 of the second housing part 40 projects.

The annular projection 50 at the same time serves as a rear stopper 52 for a control slide 54 whose cylindrical circumferential wall 56 can be pushed across the coolant pump impeller 20 so that a free cross-section of an annular gap 58 between an outlet 60 of the coolant pump impeller 20 and the delivery duct 12 is controlled. The coolant flow delivered through the coolant circuit is thus controlled depending on the position of the control slide 54.

Besides the cylindrical circumferential wall 56, the control slide 54 comprises a bottom 62 having an inner opening 64 from whose outer circumference the cylindrical circumferential wall 56 axially extends through an annular gap 66 between the first inner housing part 28 and the outer housing 10 towards the axially adjoining annular gap 58. A respective piston ring 68 is arranged in a radial groove at the inner circumference and at the outer circumference of the bottom 62 via which piston rings 68 the control slide 54 is slidingly supported in the radially inner area on the first inner housing part 28 and in the radially outer area in the annular projection 50 of the second housing part 40.

On the side of the control slide 54 facing away from the coolant pump impeller 20, a first pressure chamber 70 is located which is axially delimited by the second housing part 40 and the bottom 62 of the control slide 54, which is delimited radially outwards by the outer housing 10 and/or the annular projection 50 of the second housing part 40, and which is delimited radially inwards by the first housing part 28. On the side of the bottom 62 facing the coolant pump impeller 20, a second pressure chamber 72 is formed which is axially delimited by the bottom 62 and the first housing part 28, which is delimited radially outwards by the cylindrical circumferential wall 56 of the control slide 54, and which is delimited radially inwards by the first inner housing part 28. The cylindrical circumferential wall 56 of the control slide 54 is pushed into the annular gap 58 or is removed from the annular gap 58 Depending on the pressure difference prevailing at the bottom 62 of the control slide 54 in the first pressure chamber 70 and in the second pressure chamber 72.

The pressure difference required for this purpose is generated by the control pump 32 and is supplied to the respective first pressure chamber 70 and second pressure chamber 72 by a valve 74 configured as a 3/2-way magnetic valve. For this purpose, an accommodation opening 76 for the valve 74 is formed in the second housing part 40, via which valve 74 a throughflow cross-section 80 of a pressure duct 82 is controlled depending on the position of its closing body 78. The pressure duct 82 extends from the outlet 30 of the flow duct 26 of the control pump 32 up to the first pressure chamber 70. The second pressure chamber 72 is connected to the flow duct 26 via a connecting duct which is formed in the first inner housing part 28, wherein this connecting duct is configured as a bore which extends from an area of the inlet of the flow duct 26 directly into the second pressure chamber 72. A third flow connection (not shown in the drawing) of the control valve leads directly to the suction side of the coolant pump.

If the coolant pump is to deliver a maximum coolant flow during operation, the annular gap 58 at the outlet 60 of the coolant pump impeller 20 is completely opened by not applying current to the magnetic valve 74, whereby, via a spring force, the closing body 78 is moved into a position in which it closes the throughflow cross-section 80 of the pressure duct 82. As a result, no pressure is built up by the coolant in the first pressure chamber 70, but the coolant present in the first pressure chamber 70 can flow off to the pump inlet 14 of the coolant pump via the other flow connection (not shown in the drawing) of the magnetic valve 74 which is open in this state. In this state, the control pump 32 instead delivers against the closed throughflow cross-section 80, whereby an increased pressure builds up in the overall flow duct 26, which also acts in the area of the inlet of the control pump 32, and, accordingly, also builds up in the second pressure chamber 72 via the connecting duct. This increased pressure in the second pressure chamber 72 results in a pressure difference at the bottom 62 of the control slide 54, which leads to the control slide 54 being moved into a position in which the annular gap 58 is opened and thus a maximum delivery of the coolant pump is provided.

If the engine control requires a reduced coolant flow to the cooling circuit, as is the case, for example, during the warm-up phase of the internal combustion engine after a cold start, current is applied to the magnetic valve 74, whereby the closing body 78 opens the throughflow cross-section 80 of the pressure duct 82. The pressure produced at the outlet of the control pump 32 is accordingly also generated in the pressure duct 82 and in the first pressure chamber 70, while at the same time the pressure in the second pressure chamber 72 decreases since a reduced pressure occurs in the area of the inlet due to the intake of the coolant. The coolant present in the second pressure chamber 72 is initially also extracted. In this state, a pressure difference is accordingly again present at the bottom 62 of the control slide 54, which pressure difference results in the control slide 54 being moved into the annular gap 58 and thus the coolant flow in the cooling circuit being interrupted.

If a magnetic valve 74 configured as a proportional valve or as a clocked valve having a variable duty ratio is used, it is also possible to move the valve 74 into intermediate positions, whereby an equilibrium of forces is attainable for each position of the control slide 54 so that a complete control of the throughflow cross-section of the annular gap 58 is provided.

No spring force is accordingly used to adjust the control slide 54. The control slide 54 of this coolant pump, during a cut-off of the internal combustion engine and the resultant standstill of both the coolant pump impeller 20 and the control pump impeller 22, instead remains in the respective position which it has assumed at the time of cut-off since a pressure in a pressure chamber can merely be decreased by leakages, which, however, does not lead to a readjustment of the control slide 54 because, in the static state, a pressure equilibrium prevails in both the first pressure chamber 70 and in the second pressure chamber 72, but for adjusting purposes, frictional forces would need to be overcome.

According to the present invention, this is utilized to control the coolant pump so that during a cut-off of the internal combustion engine, the magnetic valve 74 is switched so that the control slide 54 is in a respective optimum initial position for the following starting process. This is in particular performed depending on the prevailing coolant temperature as compared with a defined threshold value which corresponds to the normal operation temperature of the internal combustion engine of approximately 95° C., for example.

For example, if the ignition of the internal combustion engine is cut off and the temperature of the coolant is 96° C., thus exceeding the threshold value, no current is applied to the magnetic valve 74, whereby the pressure in the second pressure chamber 72 increases and the control slide 54 is moved into its position for opening the annular gap 58. As a result, in the case of a switched-off internal combustion engine, the coolant continues to circulate due to the thermosiphon effect and thus continues to absorb heat of the still hot internal combustion engine. The reverse action can, however, be taken for this cut-off process and the control slide 54 can be moved into a position to close the annular gap 58 by applying current to the magnetic valve 74. A cooling process occurs as a result during a long standstill, but the heat is stored a little longer. During a following start, the control slide 54 would be in its closing position so that a rapid reheating of the coolant for shortening the warm-up phase would occur. Whether the control slide 54 is moved into its open or closed position when the ignition is cut off can be decided depending on the external temperature. At particularly high temperatures, the control slide 54 would rather be moved into the open state to provide adequate heat dissipation and thus prevent an overheating of the engine.

A corresponding control can also be performed for vehicles having an automatic start-stop system. If the engine is cut off during the start-stop operation, the control slide 54 should be moved into the position for opening the annular gap 58 depending on the prevailing coolant temperature when the operating temperature has been reached and the threshold value is thus exceeded since only short standstill periods are assumed during which a major cooling is not expected but the coolant may be overheated by the warm engine. In the cut-off state, a circulation is accordingly caused by the thermosiphon effect. During the start of the internal combustion engine, the control slide is then in this position so that a maximum coolant flow can be delivered without any delay. If the operating temperature has not yet been reached, the control slide 54 is kept in the position for closing the annular gap 58 or moved into this position during the switch-off process. A circulation of the coolant is thus prevented, and the engine can transfer its heat to the stagnant coolant. During a new start, the stagnant coolant is further heated so that the warm-up phase is shortened. The control slide 54 is subsequently merely slowly opened to prevent a surge of cold coolant from flowing from the pump into the crankcase.

A corresponding control should also be performed in the coasting mode of the motor vehicle during which the internal combustion engine is decoupled from the power train and is switched off. After the switch-off of the internal combustion engine, the current feed to the valve 74 can subsequently be terminated without the control slide 54 being moved when the engine is switched off. After a new start of the engine, the control slide is controlled as required. This subsequent control can either be performed via a closed control loop with a position feedback of the control slide or can be carried out without a sensor system.

Such a method allows for a control of the coolant flow within physical limits when the vehicle is cut off and allows for an optimum positioning of the control slide, and thus an optimum coolant flow, immediately during the starting process of the vehicle, whereby the cold running phase can be shortened. The existing heat quantities can be better utilized on the whole, while overheating is reliably avoided in all operating conditions.

It should be appreciated that the scope of protection of the present invention is not limited to the described exemplary embodiment. Other coolant pumps can in particular be used, wherein it is merely important that the control slide not be moved by external forces after the switch-off process. Various switch points for controlling purposes can also be selected or intermediate positions of the slide can be approached if reasonable. Reference should also be had to the appended claims.

What is claimed is:

1. A method for controlling a coolant pump which is configured to be mechanically controllable for an internal combustion engine, the method comprising:

delivering a coolant via a coolant pump impeller into a delivery duct which surrounds the coolant pump impeller to a pump outlet;

adjusting the delivery based on a position of a control slide, wherein the control slide is configured to be adjustable so as to control a throughflow cross-section of an annular gap arranged between an outlet of the coolant pump impeller and the delivery duct;

filling a first pressure chamber arranged on a first side of the control slide with a pressurized coolant to decrease the throughflow cross-section and to thereby decrease the coolant volume flow delivered to the pump outlet, or filling a second pressure space arranged on a second side of the control slide which is axially opposite to the first side with the pressurized coolant to increase the throughflow cross-section and to thereby increase the coolant volume flow delivered to the pump outlet; and moving the control slide into a defined position during a switch-off of the internal combustion engine dependent on a coolant temperature, wherein the control slide remains in the defined position until the internal combustion engine is started.

2. The method as recited in claim 1, wherein, during the switch-off of the internal combustion engine, the method further comprises:

moving the control slide into a first position to close the annular gap when the coolant temperature falls below a defined threshold value.

3. The method as recited in claim 2, wherein, during the switch-off of the internal combustion engine, the method further comprises:

moving the control slide into a second position to fully open the annular gap when the coolant temperature corresponds to the defined threshold value or exceeds the defined threshold value.

4. The method as recited in claim 3, wherein the opening of the annular gap is performed by providing a progressive pressure increase in the second pressure chamber.

5. The method as recited in claim 3, wherein the defined threshold value for the coolant temperature is provided as a function of the ambient temperature and is saved in a characteristic map.

6. The method as recited in claim 3, wherein the defined threshold value corresponds to a desired value for an operating temperature of the coolant during operation as defined in an engine control.

7. The method as recited in claim 3, wherein, depending on a position of a 3/2-way electromagnetic valve, the pressurized coolant is fed to the first pressure chamber or to the second pressure chamber, and the method further comprises:

driving the 3/2-way electromagnetic valve during the switch-off of the internal combustion engine to move the control slide into the first position or into the second position.

8. The method as recited in claim 1, wherein, during the switch-off of the internal combustion engine, the method further comprises:

performing a control via a cut-off of an ignition of the internal combustion engine.

9. The method as recited in claim 8, further comprising:

moving the control slide into a position to close the annular gap during the cut-off of the ignition of the internal combustion engine.

10. The method as recited in claim 8, wherein, the control is performed in a start-stop operation.

11. The method as recited in claim 8, wherein the control is performed in a coasting mode of a vehicle.

* * * * *